US006923391B1

(12) United States Patent
Gibson

(10) Patent No.: US 6,923,391 B1
(45) Date of Patent: Aug. 2, 2005

(54) PULVERIZER

(76) Inventor: Dan Allen Gibson, 1412 Westfield, Reno, NV (US) 89509

( * ) Notice: Subject to any disclaimer, the term of this patent is extended or adjusted under 35 U.S.C. 154(b) by 0 days.

(21) Appl. No.: 10/654,246

(22) Filed: Sep. 2, 2003

Related U.S. Application Data

(60) Provisional application No. 60/407,353, filed on Aug. 30, 2002.

(51) Int. Cl.[7] ..... B02C 13/14

(52) U.S. Cl. ..... 241/5; 241/26; 241/189.1; 241/275; 241/284

(58) Field of Search ..... 241/284, 189.1, 241/275, 5, 26, 187, 188.1, 46.08, 46.017

(56) References Cited

U.S. PATENT DOCUMENTS 1,697,704 A 1/1929 Wood
2,661,158 A * 12/1953 Fogel ..... 241/80
2,705,596 A * 4/1955 Poyser ..... 241/32
4,134,555 A * 1/1979 Rosselet ..... 241/46.013
5,020,734 A 6/1991 Novotny et al. ..... 241/119
5,544,824 A 8/1996 Inoki ..... 241/80

* cited by examiner

*Primary Examiner*—Mark Rosenbaum
(74) *Attorney, Agent, or Firm*—Sierra Patent Group, Ltd.

(57) ABSTRACT

The disclosed device is directed toward a pulverizer including a pulverizing chamber formed between a table, a cover, and side walls. The side walls are coupled between the table and the cover. At least three rotary plates are disposed in the table. Each of the rotary plates include a top surface and a bottom surface, the top surface being proximate the pulverizing chamber. At least one hammer is coupled to each rotary plate on the top surface of the rotary plate. A flow slot is formed between each rotary plate and the table, wherein the flow slot is configured to fluidly couple pulverized material through each flow slot to a discharge. A material feeder is coupled to the cover. The material feeder is configured to feed material to be pulverized into the pulverizing chamber through the cover.

40 Claims, 4 Drawing Sheets

PULVERIZER

PRIORITY CLAIM

This application claims priority to Provisional Patent Application No. 60/407,353 filed with the United States Patent and Trademark Office on Aug. 30, 2002.

BACKGROUND

The present disclosure relates to a mechanism for reducing material size and particularly to a pulverizer for creating fine particulate.

Materials such as ore, contain minerals and elements that have value in a purified and refined form. The valued minerals and elements are dispersed throughout the ore. The ore must be broken down and separated from the valuable minerals and elements. Ore is mined and removed from the source in a load property (stone) sized material. Further processing is required to reduce the ore into a manageable size for separation. The ore is processed into a fine powder (placer property) whereby the valuable elements can be separated, refined, concentrated and amalgamated. A gravity recovery system is one example to recover gold from a powder.

The prior art includes many devices for processing ore and other unrefined materials into powders ready for separation. Mills, rollers, crushers and the like utilize large components to process the materials. The prior art machines are large and limited in the rate at which the material can be processed. The prior art machines also produce inconsistently sized product. The result is that ore and other materials are not efficiently processed. Time in processing is lost and the quality of the output from the prior art is not consistent.

What is needed in the art is a pulverizer that rapidly reduces materials into a fine powder ready for further processing.

SUMMARY

The disclosed device is directed toward a pulverizer including a pulverizing chamber formed between a table, a cover, and side walls. The side walls are coupled between the table and the cover. At least three rotary plates are disposed in the table. Each of the rotary plates include a top surface and a bottom surface, the top surface being proximate the pulverizing chamber. At least one hammer is coupled to each rotary plate on the top surface of the rotary plate. A flow slot is formed between each rotary plate and the table, wherein the flow slot is configured to fluidly couple pulverized material through each flow slot to a discharge. A material feeder is coupled to the cover. The material feeder is configured to feed material to be pulverized into the pulverizing chamber through the cover.

In another embodiment the disclosed device is directed toward a pulverizer comprising a table having a top and a bottom. A side wall is coupled to the top of the table. A cover is coupled to the side wall opposite the table, wherein the table, the side wall and the cover form a pulverizing chamber. A feeder is coupled to the cover. A discharge is coupled to the bottom of the table. A set of three rotary plates is mounted co-planar to the top of the table in the pulverizing chamber. Each of the rotary plates are coupled to a drive motor proximate the bottom of the table and each of the rotary plates have at least one hammer coupled to the rotary plates opposite the drive motor. A flow slot is formed between each rotary plate and the table.

A method of using a pulverizer is disclosed. The method includes activating a pulverizer comprising a pulverizing chamber formed between a table, a cover, and side walls. The side walls are coupled between the table and the cover. At least three rotary plates are disposed in the table. Each of the rotary plates has a top surface and a bottom surface. The top surface is proximate the pulverizing chamber. At least one hammer is coupled to each rotary plate on the top surface of the rotary plate. A flow slot is formed between each rotary plate and the table. The method includes feeding at least one of a wet material and a dry material into the feeder. The method includes directing the material into the pulverizing chamber. The method includes impacting the material with at least one hammer. The method includes propelling the material with at least one hammer. The method includes directing the material to self-impact. The method includes flowing the material through the flow slot. The method includes discharging the material out of the discharge.

BRIEF DESCRIPTION OF THE DRAWINGS

Referring now to the figures, wherein like elements are numbered the same.

DETAILED DESCRIPTION

Persons of ordinary skill in the art will realize that the following description of the present disclosure is illustrative only and not in any way limiting. Other embodiments of the invention will readily suggest themselves to such skilled persons having the benefit of this disclosure.

The present disclosure describes a pulverizer system for processing feed material of various species producing a fine powder material. The pulverizer system includes a table having at least three rotary plates mounted in the table substantially horizontal and co-planar with the table. The rotary plates including a set of hammers coupled to the top of the plates. The hammers being made of hardened metal alloy. A drive motor is coupled to each rotary plate to rotate the rotary plate and hammers attached thereto. The table is mounted upright on a set of legs. A side wall or set of walls are mounted on the table upright and opposite the drive motors. The side wall includes reinforced elements of abrasion resistant material for receiving and rebounding materials mobilized by the rotating hammers and rotary plates. A cover is mounted on top of the side wall to form a pulverizing chamber with the side wall and table. A material feeder can be integral or demountably coupled to the cover. The material feeder is configured to feed material to be pulverized into the pulverizing chamber through the cover. The material fed into the pulverizing chamber is processed into fine powder by being impacted and propelled by each hammer on each rotary plate. The material is moved into an impact region located between each of the rotary plates. In the impact region the material self-impacts and breaks up under the forces of impact. A flow slot is formed between each rotary plate and the table. The flow slot is sized to permit a predetermined size material flow by gravity through the flow slot and into a discharge located below the table. The pulverized material can be directed out the discharge for further processing. A high percentage of at least 100 mesh material can be produced at a rapid rate with the pulverizing system disclosed herein. The pulverizer system can be scaled up or down to handle the material to be processed as well as provide the rate of production desired.

Figure 1:
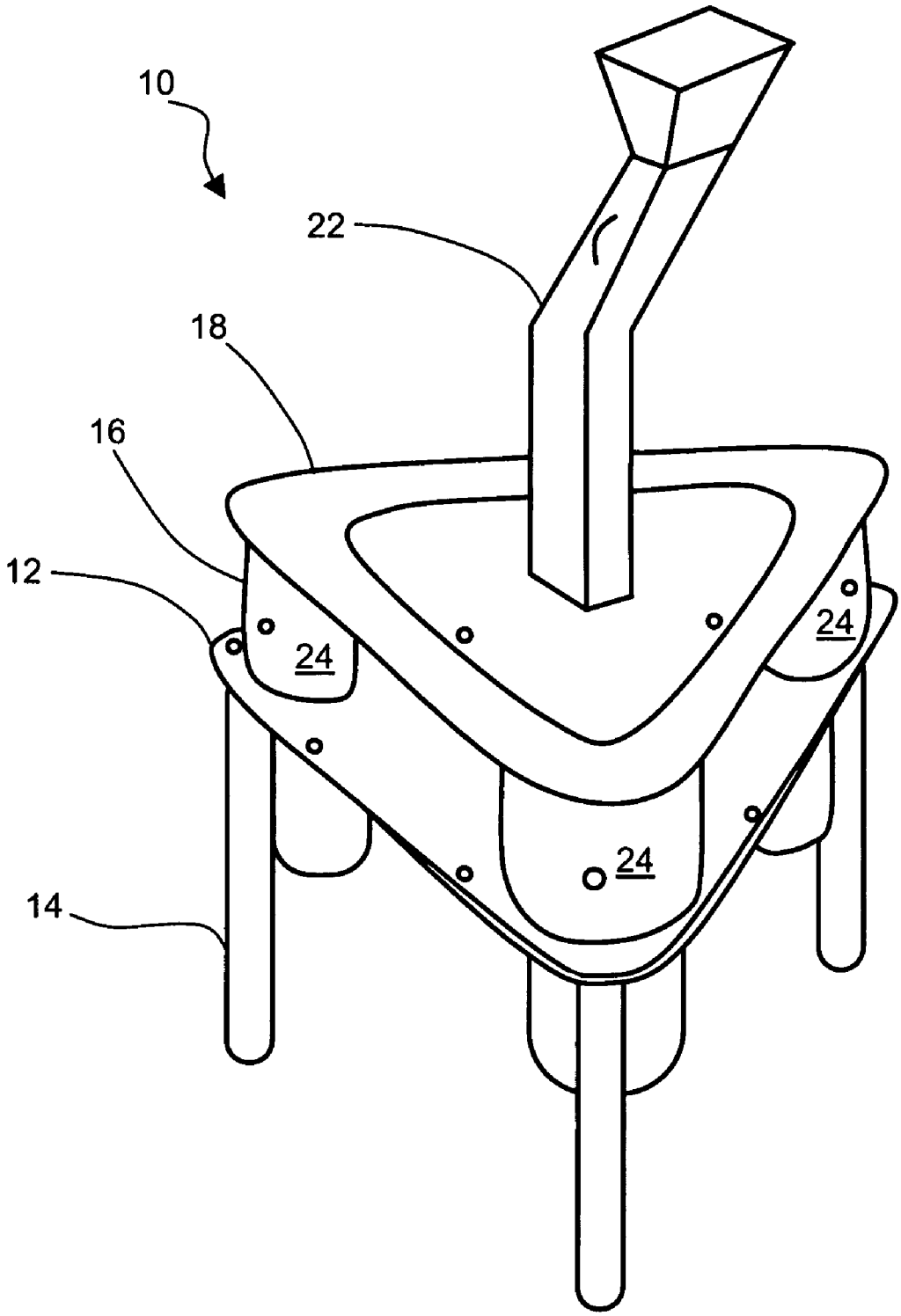
FIG. 1 is a perspective view of an exemplary pulverizer system.
Figure 2:
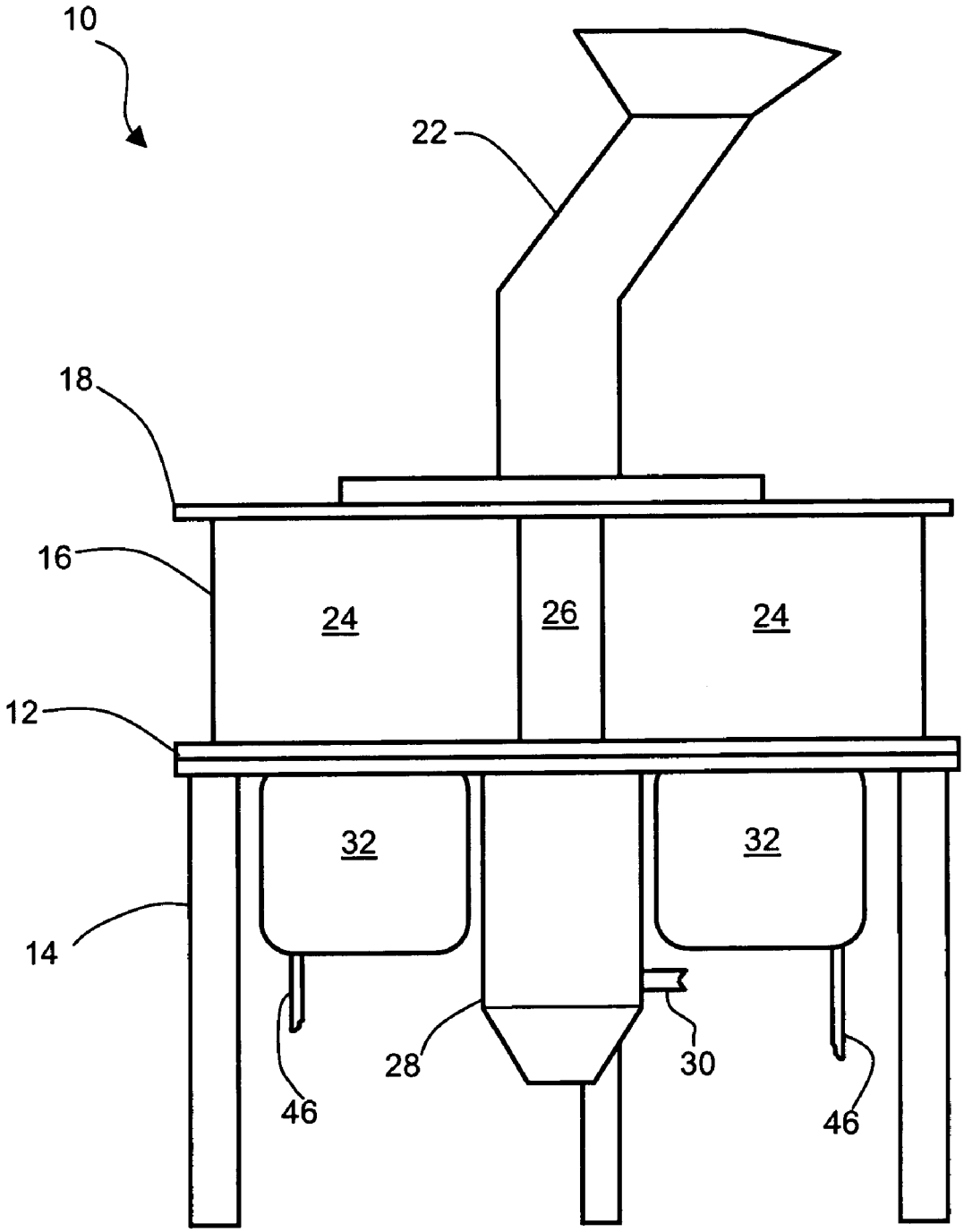
FIG. 2 is a side view of an exemplary pulverizer system.

Referring to FIG. 1 a perspective view and FIG. 2 a side view of an exemplary pulverizer system 10 is illustrated. The pulverizer system 10 includes a table mounted on legs 14. The table 12 is set substantially horizontal with respect to gravity. A side wall 16 is mounted on top of the table 12 opposite the legs 14. The side wall 16 supports a cover 18 mounted on top of the side wall 16. The table 12, side wall 16 and cover 18 form a pulverizing chamber 20 (see FIG. 3). The cover 18 can include a feeder 22 or in a preferred exemplary embodiment, the feeder 22 can be demountably coupled to the cover 18 and sealed with a gasket 19. The feeder 22 is configured to feed material into the pulverizing chamber 20. The feeder 22 can include features to handle fluids, solids and a combination of fluids and solids. In an exemplary embodiment, the feeder 22 can be configured to handle a water and solids mix. The water/solid mix can include a maximum of 40% solids in a preferred exemplary embodiment. The entire pulverizer system 10 is configured to operate wet or dry and can process fluids and solids and a combination thereof. The cover 18 and table 12 can be shaped in a substantially equilateral triangle shape. The side wall 16 can follow along the periphery of the shape as well as have substantially circular regions 24 and substantially flat regions 26.

A discharge 28 is coupled to the bottom of the table 12 and configured to allow for the discharge of the processed material out of the pulverizer system 10. The discharge 28 can be configured to operate through gravitational forces. The discharge 28 in an alternative exemplary embodiment can include a discharge pipe 30 fluidly coupled to the discharge 28. The discharge pipe 30 can be fluidly coupled to auxiliary systems (not) shown that provide additional means for removing materials from the pulverizer system 10. An exemplary auxiliary system can be a vacuum system configured to draw a vacuum on the discharge pipe 30 and remove the lightweight and fine dust produced in the pulverizer system 10. The vacuum system can be configured to dispose of the dust and minimize contamination and airborne particulate in the ambient atmosphere. It is contemplated that other auxiliary systems can be coupled to the discharge 28 for materials handling and materials separation.

Drive motors 32 are shown mounted to the table 12 at the underside of the table 12. The drive motor 32 can include an electric motor, a pneumatic motor, a hydraulic motor, an internal combustion engine and the like.

Figure 3:
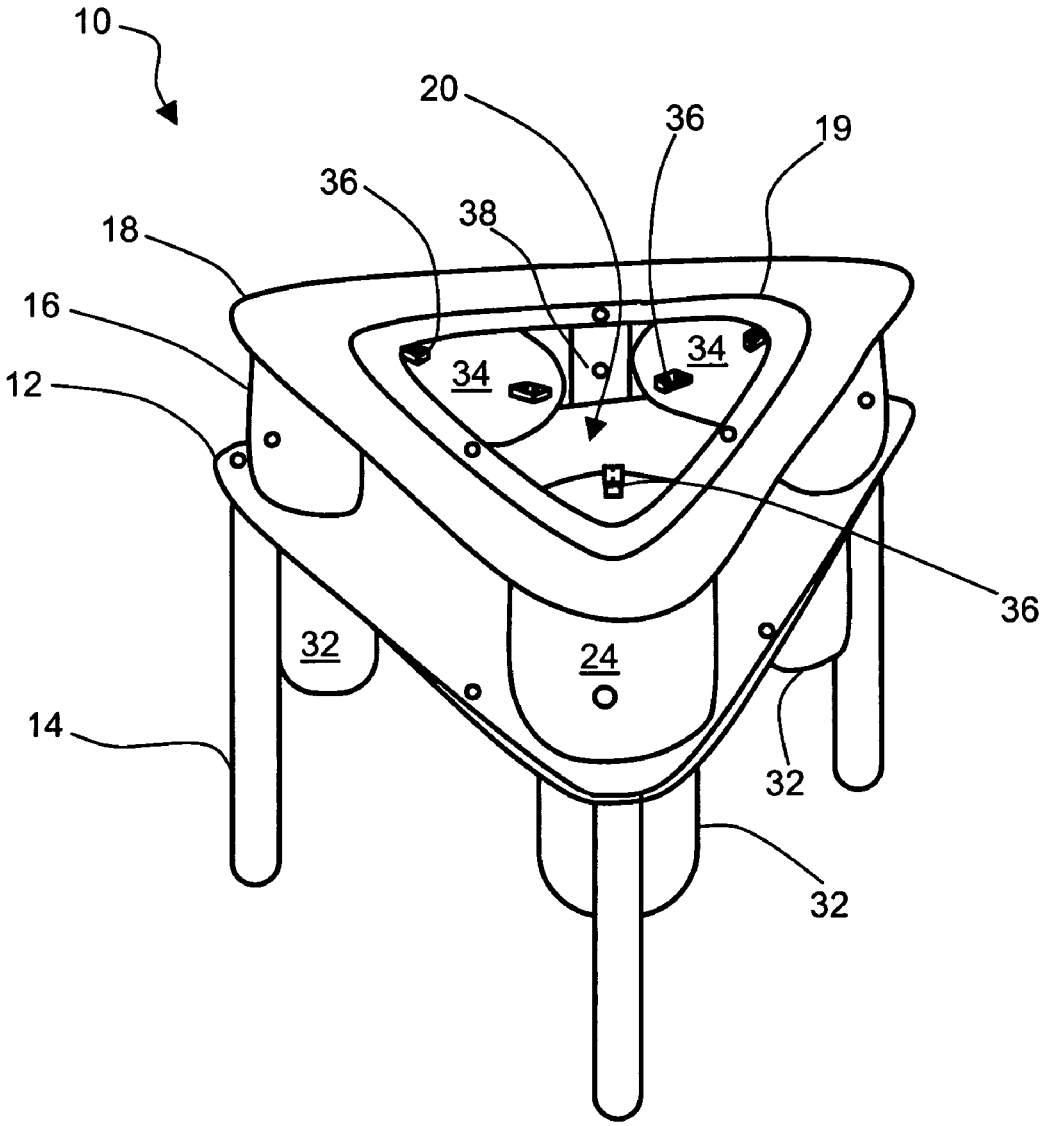
FIG. 3 is a perspective view of an exemplary pulverizer system with the feeder removed.
Figure 4:
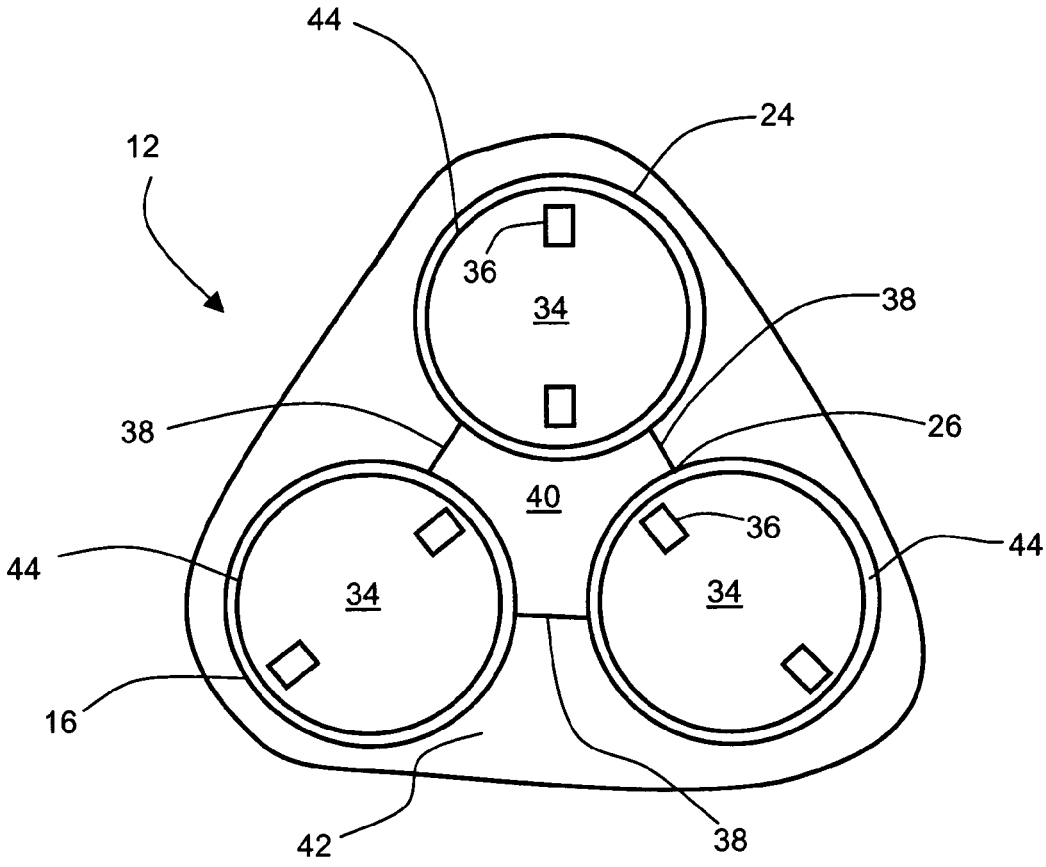
FIG. 4 is a top view of an exemplary table.

Referring also to FIG. 3 a perspective view of the exemplary pulverizer system 10 is illustrated with the feeder 22 removed and FIG. 4 a top view of the table 12. The pulverizing chamber 20 is exposed when the feeder 22 is removed. Inside the pulverizing chamber 20 is a set of three rotary plates 34. The rotary plates 34 are mounted co-planar with the table 12. The plates 34 are described a platen and planar in shape, however, alternative configurations can be employed. At least one hammer 36 is coupled to each rotary plate 32. The hammer 36 can be integral or in a preferred exemplary embodiment, the hammer 36 is configured as a block that is fastened to the rotary plate 34 via fasteners. The hammer 36 can be removed and adjusted to expose new surfaces that are not worn to extend the life of the hammer 36. A reinforced element 38 can be coupled to the side wall 16 proximate the flat region 26 and be configured to receive and rebound the materials propelled in the pulverizer chamber 20. The reinforcement elements 38 can also be removably mounted to the surfaces of the side wall 16, cover 18, and table 12. The surfaces that are exposed to impact from materials within the pulverizing chamber 20 can be plated, coated and treated in order to resist wear.

An impact region 40 is formed between the three rotary plates 34 and the reinforced elements 38. The impact region 40 with the pulverizing chamber 20 is configured to allow for the material to collide and self-impact, i.e., material-on-material collisions. The impact region 40 is bounded by the reinforced element 38 of the substantially flat region 26 of side wall 16, an upper surface 42 of the table 12, and the underside of the cover 18 or the material feeder 22. The surfaces exposed to the impact region 40 can comprise abrasion resistant steel and other alloys that are abrasion resistant. The abrasion resistant materials can be configured as demountable plates that can be replaced. In another exemplary embodiment, the surfaces within the impact region can be made of specialized resistant materials designed to resist wear from exposure to the materials being processed. The materials can be resistant to chemical attack, heat resistant, resistant to acid, rust proof, and the like. The impact region 40 is configured to promote the self-impact of the material in the pulverizing chamber 20 as well as material entering the pulverizing chamber 20. The impact region 40 is configured to contain and restrict the material being processed such that the material pulverizes with the pulverizing chamber 20. In the preferred exemplary embodiment, the impact region 40 is located inside the equilateral triangle pattern formed by the orientation of the three rotary plates 34. The flat regions 26 of the side wall 16 align along the line of the equilateral triangle pattern from corner to corner and form a part of the boundary of the impact region 40. In the configuration described above three flat regions 26 are formed along the edges of the triangular pattern between each of the three rotary plates 34. The reinforced element 38 is disposed on the flat region 26 and faces the impact region 40. The rotating hammers 36 on the rotary plates 34 form additional physical boundaries to the impact region 40, such that materials impacting in the impact region 40 that are directed into the rotating hammers 36 are impacted and redirected into the impact region 40 to be further collided with other material and reduced in size.

A flow slot 44 is formed between each rotary plate 34 and the upper surface 42 of the table 12. The flow slot 44 is dimensioned for a predetermined size of material to flow by gravity through the flow slot to the discharge 28. In a preferred exemplary embodiment the flow slot 44 is sized to pass a 100 mesh sized material. In other exemplary embodiments, the flow slot 44 is sized to pass from about 100 mesh size to about 600 mesh size materials. The flow slot 44 can be sized to pass certain predetermined sizes dependent on the type of material to be processed. The flow slot 44 can have beveled features formed on the edges of the rotary plates 34 and the upper surface 42 of the table 12. The beveled feature can be varied to match the material type and material size to be produced.

The rotary plates 34 are shown as a formation of three rotary plates 34 configured in a pattern having the rotary plates 34 at the corners of an equilateral triangle. It is contemplated that other combinations of rotary plates 34 can be assembled, such as five or seven plates in a similar triangular pattern repeated and expanded laterally. In those embodiments, there can be additional impact regions 40 between the rotary plates 34 and side wall 16. The rotary plate 34 is substantially planar as depicted. In alternate exemplary embodiments, the rotary plate 34 can have non-planar surfaces and can integrate the hammer 36.

The drive motor 32 rotates the rotary plate 34. In the preferred embodiment, there are three electric drive motors 32, each drive motor is directly coupled to the rotary plate 34 and mounted to the table opposite the upper surface 42. In exemplary embodiments, a single or multiple drive motors 32 can be coupled to the rotary plates 34 and utilize transmissions and other gearing to rotate the rotary plates 34. Hydraulic (water, hydraulic fluid), pneumatic, IC and electric driven motors are contemplated in this disclosure. In a preferred exemplary embodiment, the drive motor 32 includes a totally enclosed fan cooled motor rated at 5 horsepower. Since the pulverizer system 10 can be scaled up or down, the drive motor can also be sized to meet the system requirements. The rotational speed of the rotary plates 34 can vary with the type of drive motor 32. The speed of the drive motor 32 and the size of the rotary plates 34 are determine the speed of rotation. A variable speed drive motor 32 can be employed. The variable speed drive motor 32 can include a specialized transmission and/or control features that sense load, current, speed and other variables and subsequently vary the speed of rotation maximizing efficiency and energy use in the pulverizer system 10.

In an exemplary embodiment, a pneumatic fluid system 46 can be coupled to the drive motor 32 to pressurize the housing of the drive motor 32 (see FIG. 2). By applying a positive pressure to the motor housing, the particulate from the pulverizer system 10 can be prevented from contaminating the interior of the drive motor 32. The byproduct of the pulverizer system 10 can include fine particulate that penetrates the seals of the drive motor 32. Once the seals of the drive motor 32 are penetrated, the rotating components, such as bearings and the surfaces of the bearings become contaminated with the particulate. The particulate wears the surfaces of the bearings and greatly shortens the life of the moving parts. The addition of the pneumatic system 46 prevents the infiltration of the contaminants and greatly lengthens the bearing life in the drive motors 32.

In use the pulverizer system 10 can be employed to pulverize materials. The material can include stone and ore containing valuable minerals and elements. The materials can be fed into the feeder 22. The materials can be fed through gravity and/or through motive forces such as a fluid media, like water. The materials are deposited into the pulverizer chamber 20 proximate the impact region 40. The materials rebound and move about the impact region 40 self-impacting. As more material is fed into the pulverizing chamber 20, material is directed into the rotating hammers 36 mounted on the rotary plates 34. The hammers 36 impact the material and propel the material about the pulverizing chamber 20 and back into the impact region 40. The material having been collided with the hammers 36 has greater kinetic energy and propels into other material, self-impacting. The material is also contained and directed into the impact region 40 by the side walls 16, table 12 and cover 18. As material continues to be introduced into the impact region 40 from the feeder 22 additional collisions occur and the material is further reduced in size. When the material has been reduced into a predetermined size, the material falls through the flow slot past the rotary plates 34 and the table 12. The material passes into the discharge 28 and out of the pulverizer system 10. The material in the pulverizing chamber 20 continues to be propelled and excited such that self-impacting takes place until mostly all of the material is resized.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A pulverizer comprising:

a pulverizing chamber formed between a table, a cover, and side walls, said side walls coupled between said table and said cover;

at least three rotary plates disposed in said table, each of said rotary plates having a top surface and a bottom surface, said top surface being proximate said pulverizing chamber;

at least one hammer coupled to each said rotary plate on said top surface of said rotary plate;

a flow slot formed between each said rotary plate and said table, wherein each said flow slot is configured to fluidly couple pulverized material through each said flow slot to a discharge; and a material feeder coupled to said cover, said material feeder configured to feed material to be pulverized into said pulverizing chamber through said cover.

2. The pulverizer of claim 1 wherein said at least three rotary plates are spaced apart in a pattern configured about each corner of an equilateral triangle forming a pulverizing region in said pulverizing chamber between said rotary plates.

3. The pulverizer of claim 1 wherein each of said rotary plates is coupled to a motor, wherein said motor is mounted outside of said pulverizing chamber to said table.

4. The pulverizer of claim 1 further comprising:

at least one reinforced element coupled to said side walls configured to receive materials moved by said at least one hammer.

5. The pulverizer of claim 1 wherein said table and said cover are substantially triangular in shape forming the upper and lower boundary of said pulverizing chamber.

6. The pulverizer of claim 1 wherein said cover and said table comprise an abrasion resistant material.

7. The pulverizer of claim 1 wherein said cover includes an opening configured to receive materials fed through said material feeder.

8. The pulverizer of claim 1 wherein said material feeder is configured to feed material into said chamber between said at least three rotary plates.

9. The pulverizer of claim 1 wherein said material feeder is configured to flow a fluid and solid material mixture into said pulverizing chamber.

10. The pulverizer of claim 1 wherein said at least one hammer includes a first hammer coupled to each said rotary plate and a second hammer coupled to each said rotary plate opposite said first hammer, wherein said first hammer and said second hammer are proximate said flow slot.

11. The pulverizer of claim 1 wherein said at least three rotary plates comprise abrasion resistant material.

12. The pulverizer of claim 1 wherein said at least one hammer comprises a tungsten-carbide alloy.

13. The pulverizer of claim 1 wherein said at least three rotary plates are substantially horizontal and coplanar with said table.

14. The pulverizer of claim 1 wherein each said flow slot includes beveled edges formed in said at least three rotary plates and said table proximate said at least three rotary plates.

15. The pulverizer of claim 1 wherein said pulverizer chamber is configured to direct said material in said pulverizer to self-impact.

16. The pulverizer of claim 15 wherein said self-impact of said material occurs primarily in an impact region of said table between said at least three rotary plates and said at least one reinforced element.

17. The pulverizer of claim 1 wherein said at least three rotary plates are rotated by a motive force selected from the group consisting of a pneumatic motor, an electric motor and a hydraulic motor.

18. The pulverizer of claim 1 wherein said discharge comprises a gravity mode of material discharge.

19. The pulverizer of claim 1 wherein said flow slot is configured to pass a predetermined size pulverized material through said table to said discharge.

20. The pulverizer of claim 1 wherein said discharge comprises a fluid means of material discharge.

21. A pulverizer comprising:

a table having a top and a bottom;

a side wall coupled to said top of said table;

a cover coupled to said side wall opposite said table, wherein said table, said side wall and said cover form a pulverizing chamber;

a feeder coupled to said cover;

a discharge coupled to said bottom of said table;

a set of three rotary plates mounted co-planar to said top of said table in said pulverizing chamber, each of said rotary plates being coupled to a drive motor proximate said bottom of said table and each of said rotary plates having at least one hammer coupled to said rotary plates opposite said drive motor; and a flow slot formed between each said rotary plate and said table.

22. The pulverizer of claim 21 further comprising:

an impact region formed between said set of three rotary plates and said side wall, said impact region configured to pulverize material fed into the pulverizer.

23. The pulverizer of claim 21 wherein said set of three rotary plates are mounted in a pattern formed in an equilateral triangle wherein each said rotary plate is at a corner of said pattern.

24. The pulverizer of claim 23 wherein said impact region is formed within said pattern.

25. The pulverizer of claim 21 wherein said at least one hammer comprises a set of hammers demountably coupled to said rotary plate opposing along a diameter of said plate and proximate said flow slot.

26. The pulverizer of claim 21 wherein said flow slot is configured to pass a predetermined size material to said discharge.

27. The pulverizer of claim 21 wherein said rotary plates rotate said at least one hammer and said at least one hammer is configured to impact material disposed in said pulverizing chamber and configured to propel said material into an impact region to be self-impacted.

28. The pulverizer of claim 21 wherein said feeder, said pulverizing chamber, said rotary plates and said discharge are configured to process at least one of a wet material and a dry material.

29. The pulverizer of claim 21 wherein said drive motor is variable speed drive.

30. The pulverizer of claim 21 wherein said at least one hammer is configured as a block and configured to be realigned such that more than one face of said block can be used to impact material.

31. The pulverizer of claim 21 wherein demountable abrasion resistant material plate is coupled to said cover, side wall and said table within said pulverizing chamber.

32. The pulverizer of claim 21 wherein said pulverizer is configured to feed ore material and discharge at least a majority of 100 mesh particulate.

33. The pulverizer of claim 21 wherein the pulverizer is scalable.

34. A method of using a pulverizer comprising:

activating a pulverizer comprising a pulverizing chamber formed between a table, a cover, and side walls, said side walls coupled between said table and said cover, at least three rotary plates disposed in said table, each of said rotary plates having a top surface and a bottom surface, said top surface being proximate said pulverizing chamber, at least one hammer coupled to each said rotary plate on said top surface of said rotary plate, a flow slot formed between each said rotary plate and said table;

feeding at least one of a wet material and a dry material into said feeder;

directing said material into said pulverizing chamber;

impacting said material with said at least one hammer;

propelling said material with said at least one hammer;

directing said material to self-impact;

flowing said material through said flow slot; and discharging said material out of said discharge.

35. The method of claim 34 wherein said at least three rotary plates are rotated by a drive motor coupled to said at least three rotary plates.

36. The method of claim 34 wherein said directing said material includes directing said material into an impact region located between said at least three rotary plates and said side walls in said pulverizing chamber.

37. The method of claim 36 wherein directing said material to self-impact includes directing said material into said impact region.

38. The method of claim 34 wherein feeding said material, flowing said material and discharging said material are performed through one of a gravity means and a mechanical means.

39. The method of claim 34 wherein a pneumatic pressure system is coupled to a drive motor coupled to said set of at least three rotary plates and said method includes pressurizing said drive motor with said pneumatic pressure system maintaining an drive motor pressure greater than the pulverizer pressure preventing contaminants from entering said drive motor.

40. The method of claim 34 wherein directing said material to self-impact comprises material-to-material collision.

* * * * *